US009264822B2

(12) United States Patent
Zhang et al.

(10) Patent No.: US 9,264,822 B2
(45) **Date of Patent: *Feb. 16, 2016**

(54) SYSTEM FOR AUTOMATIC RECEPTION ENHANCEMENT OF HEARING ASSISTANCE DEVICES

(71) Applicant: Starkey Laboratories, Inc., Eden Prairie, MN (US)

(72) Inventors: Tao Zhang, Eden Prairie, MN (US); William S. Woods, Berkeley, CA (US); Timothy Daniel Trine, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 142 days.

This patent is subject to a terminal disclaimer.

(21) Appl. No.: 14/037,534

(22) Filed: Sep. 26, 2013

(65) Prior Publication Data

US 2014/0023213 A1 Jan. 23, 2014

Related U.S. Application Data

(63) Continuation of application No. 13/304,825, filed on Nov. 28, 2011, now abandoned, which is a continuation of application No. 11/686,275, filed on Mar. 14, 2007, now Pat. No. 8,068,627.

(60) Provisional application No. 60/743,481, filed on Mar. 14, 2006.

(51) Int. Cl.
*H04R 25/00* (2006.01)

(52) U.S. Cl.
CPC ..... *H04R 25/405* (2013.01); *H04R 25/70* (2013.01)

(58) Field of Classification Search
CPC .. H04R 25/505; H04R 2225/41; H04R 25/70; H04R 2225/39; H04R 25/407; H04R 25/552; H04R 2430/03; H04R 25/405; H04R 3/005; H04R 25/305; H04R 25/40; H04R 25/43; H04R 2225/43; H04R 2225/55; H04R 25/507; H04R 25/554; H04R 2225/025; H04R 2225/53; H04R 2410/07; H04R 2420/07; H04R 2499/11; H04R 25/30; H04R 25/356; H04R 25/453; H04R 25/556; H04R 25/75; H04R 29/005; H04R 29/006; H04R 5/04; G10L 2021/065
USPC ..... 381/313, 317, 318, 312, 328, 92
See application file for complete search history.

(56) References Cited

U.S. PATENT DOCUMENTS 4,630,302 A 12/1986 Kryter
5,604,812 A 2/1997 Meyer (Continued)

FOREIGN PATENT DOCUMENTS

AU 2005100274 A4 6/2005
AU 2002224722 B2 4/2008

(Continued)

OTHER PUBLICATIONS

"European Application Serial No. 07251012.6, Response filed Mar. 4, 2014 to Extended European Search Report mailed Aug. 7, 2013", 27 pgs.

(Continued)

*Primary Examiner* — Davetta W Goins
*Assistant Examiner* — Phylesha Dabney
(74) *Attorney, Agent, or Firm* — Schwegman Lundberg & Woessner, P.A.

(57) ABSTRACT

Method and apparatus for automatic reception enhancement of hearing assistance devices. The present subject matter relates to methods and apparatus for automatic reception enhancement in hearing assistance devices. It provides a power estimation scheme that is reliable against both steady and transient input. It provides a TSM estimation scheme that is effective and efficient both in terms of storage size and computational efficiency. The embodiments employing a decision tree provide a weight factor between the omnidirectional and compensated directional signal. The resulting decision logic improves speech intelligibility when talking under noisy conditions. The decision logic also improves listening comfort when exposed to noise. Additional method and apparatus can be found in the specification and as provided by the attached claims and their equivalents.

20 Claims, 4 Drawing Sheets

(56) References Cited

U.S. PATENT DOCUMENTS

| | | | |
|---|---|---|---|
| 6,389,142 | B1 | 5/2002 | Hagen et al. |
| 6,522,756 | B1 | 2/2003 | Maisano et al. |
| 6,718,301 | B1 | 4/2004 | Woods |
| 6,782,361 | B1 | 8/2004 | El-Maleh et al. |
| 6,912,289 | B2 | 6/2005 | Vonlanthen et al. |
| 7,149,320 | B2 | 12/2006 | Haykin et al. |
| 7,158,931 | B2 | 1/2007 | Allegro |
| 7,349,549 | B2 | 3/2008 | Bachler et al. |
| 7,383,178 | B2 | 6/2008 | Visser et al. |
| 7,428,312 | B2 | 9/2008 | Meier et al. |
| 7,454,331 | B2 | 11/2008 | Vinton et al. |
| 7,986,790 | B2 | 7/2011 | Zhang et al. |
| 8,068,627 | B2 | 11/2011 | Zhang et al. |
| 8,143,620 | B1 | 3/2012 | Malinowski et al. |
| 8,494,193 | B2 | 7/2013 | Zhang et al. |
| 8,638,949 | B2 | 1/2014 | Zhang et al. |
| 2002/0012438 | A1 | 1/2002 | Leysieffer et al. |
| 2002/0039426 | A1 | 4/2002 | Takemoto et al. |
| 2002/0090098 | A1 | 7/2002 | Allegro et al. |
| 2002/0191799 | A1 | 12/2002 | Nordqvist et al. |
| 2002/0191804 | A1 | 12/2002 | Luo et al. |
| 2003/0112988 | A1 | 6/2003 | Naylor |
| 2003/0144838 | A1 | 7/2003 | Allegro |
| 2004/0015352 | A1 | 1/2004 | Ramakrishnan et al. |
| 2004/0190739 | A1 | 9/2004 | Bachler et al. |
| 2005/0069162 | A1 | 3/2005 | Haykin et al. |
| 2005/0129262 | A1 | 6/2005 | Dillon et al. |
| 2006/0215860 | A1 | 9/2006 | Wyrsch |
| 2007/0116308 | A1 | 5/2007 | Zurek et al. |
| 2007/0117510 | A1 | 5/2007 | Elixmann |
| 2007/0217620 | A1 | 9/2007 | Zhang et al. |
| 2007/0217629 | A1 | 9/2007 | Zhang et al. |
| 2007/0219784 | A1 | 9/2007 | Zhang et al. |
| 2007/0269065 | A1 | 11/2007 | Kilsgaard |
| 2007/0299671 | A1 | 12/2007 | McLachlan et al. |
| 2008/0019547 | A1 | 1/2008 | Baechler |
| 2008/0037798 | A1 | 2/2008 | Baechler et al. |
| 2008/0107296 | A1 | 5/2008 | Bachler et al. |
| 2008/0260190 | A1 | 10/2008 | Kidmose |
| 2012/0155664 | A1 | 6/2012 | Zhang et al. |
| 2012/0213392 | A1 | 8/2012 | Zhang et al. |
| 2014/0177888 | A1 | 6/2014 | Zhang et al. |

FOREIGN PATENT DOCUMENTS

| | | | |
|---|---|---|---|
| CA | 2439427 | A1 | 4/2002 |
| EP | 0396831 | A2 | 11/1990 |
| EP | 0335542 | B1 | 12/1994 |
| EP | 1256258 | B1 | 3/2005 |
| WO | WO-0176321 | A1 | 10/2001 |
| WO | WO-0232208 | A2 | 4/2002 |
| WO | WO-2004114722 | A1 | 12/2004 |

OTHER PUBLICATIONS

"U.S. Appl. No. 11/276,793, Advisory Action mailed Jan. 6, 2012", 3 pgs.
"U.S. Appl. No. 11/276,793, Final Office Action mailed Aug. 12, 2010", 27 pgs.
"U.S. Appl. No. 11/276,793, Final Office Action mailed Oct. 18, 2012", 31 pgs.
"U.S. Appl. No. 11/276,793, Final Office Action mailed Oct. 25, 2011", 29 pgs.
"U.S. Appl. No. 11/276,793, Non Final Office Action mailed Jan. 19, 2010", 23 pgs.
"U.S. Appl. No. 11/276,793, Non Final Office Action mailed Feb. 9, 2011", 25 pgs.
"U.S. Appl. No. 11/276,793, Non Final Office Action mailed Mar. 21, 2012", 28 pgs.
"U.S. Appl. No. 11/276,793, Non Final Office Action mailed May 12, 2009", 20 pgs.
"U.S. Appl. No. 11/276,793, Notice of Allowance mailed Mar. 21, 2013", 11 pgs.
"U.S. Appl. No. 11/276,793, Response filed Jan. 12, 2011 to Final Office Action mailed Aug. 12, 2010", 11 pgs.
"U.S. Appl. No. 11/276,793, Response filed Feb. 18, 2013 to Final Office Action mailed Oct. 18, 2012", 11 pgs.
"U.S. Appl. No. 11/276,793, Response filed Jun. 21, 2010 to Non Final Office Action mailed Jan. 19, 2010", 10 pgs.
"U.S. Appl. No. 11/276,793, Response filed Aug. 9, 2011 to Non Final Office Action mailed Feb. 9, 2011", 14 pgs.
"U.S. Appl. No. 11/276,793, Response filed Aug. 21, 2012 to Non Final Office Action mailed Mar. 21, 2012", 11 pgs.
"U.S. Appl. No. 11/276,793, Response filed Nov. 11, 2009 to Non Final Office Action mailed May 12, 2009", 16 pgs.
"U.S. Appl. No. 11/276,793, Response filed Dec. 27, 2011 to Final Office Action mailed Oct. 25, 2011", 12 pgs.
"U.S. Appl. No. 11/276,795, Advisory Action mailed Jan. 12, 2010", 13 pgs.
"U.S. Appl. No. 11/276,795, Decision on Pre-Appeal Brief Request mailed Apr. 14, 2010", 2 pgs.
"U.S. Appl. No. 11/276,795, Examiner Interview Summary mailed Feb. 9, 2011", 3 pgs.
"U.S. Appl. No. 11/276,795, Examiner Interview Summary mailed Mar. 11, 2011", 1 pg.
"U.S. Appl. No. 11/276,795, Final Office Action mailed Oct. 14, 2009", 15 pgs.
"U.S. Appl. No. 11/276,795, Final Office Action mailed Nov. 24, 2010", 17 pgs.
"U.S. Appl. No. 11/276,795, Non Final Office Action mailed May 7, 2009", 13 pgs.
"U.S. Appl. No. 11/276,795, Non Final Office Action mailed May 27, 2010", 14 pgs.
"U.S. Appl. No. 11/276,795, Notice of Allowance mailed Mar. 18, 2011", 12 pgs.
"U.S. Appl. No. 11/276,795, Pre-Appeal Brief Request mailed Feb. 16, 2010", 4 pgs.
"U.S. Appl. No. 11/276,795, Response filed Jan. 24, 2011 to Final Office Action mailed Nov. 24, 2010", 11 pgs.
"U.S. Appl. No. 11/276,795, Response filed Sep. 8, 2009 to Non Final Office Action mailed May 7, 2009", 10 pgs.
"U.S. Appl. No. 11/276,795, Response filed Sep. 28, 2010 to Non Final Office Action mailed May 27, 2010", 6 pgs.
"U.S. Appl. No. 11/276,795, Response filed Dec. 14, 2009 to Final Office Action mailed Oct. 14, 2009", 10 pgs.
"U.S. Appl. No. 11/686,275, Notice of Allowance mailed Aug. 31, 2011", 9 pgs.
"U.S. Appl. No. 11/686,275, Supplemental Notice of Allowability mailed Oct. 28, 2011", 3 pgs.
"U.S. Appl. No. 13/189,990, Advisory Action mailed Aug. 1, 2013", 3 pgs.
"U.S. Appl. No. 13/189,990, Final Office Action mailed May 22, 2013", 15 pgs.
"U.S. Appl. No. 13/189,990, Non Final Office Action mailed Nov. 26, 2012", 12 pgs.
"U.S. Appl. No. 13/189,990, Notice of Allowance mailed Sep. 18, 2013", 15 pgs.
"U.S. Appl. No. 13/189,990, Preliminary Amendment filed Mar. 5, 2012", 37 pgs.
"U.S. Appl. No. 13/189,990, Response filed Feb. 27, 2013 to Non Final Office Action mailed Nov. 26, 2012", 8 pgs.
"U.S. Appl. No. 13/189,990, Response filed Jul. 22, 2013 to Final Office Action mailed May 22, 2013", 8 pgs.
"U.S. Appl. No. 13/304,825, Non Final Office Action mailed Mar. 26, 2013", 5 pgs.
"European Application Serial No. 07250920.1, Extended European Search Report mailed May 11, 2007", 6 pgs.
"European Application Serial No. 07250920.1, Office Action mailed Sep. 27, 2011", 5 pgs.
"European Application Serial No. 07250920.1, Office Action Response filed Feb. 1, 2012", 15 pgs.
"European Application Serial No. 07250920.1, Preliminary Amendment filed Mar. 17, 2008", 7 pgs.
"European Application Serial No. 07251012.6, Amendment filed Mar. 3, 2014", 22 pgs.

(56) References Cited

OTHER PUBLICATIONS

"European Application Serial No. 07251012.6, Extended European Search Report mailed Aug. 7, 2013", 8 pgs.
Crochiere, Ronald E, et al., "Section 7.2.5: Weighted Overlap-Add Structures for Efficient Realization of DFT Filter Banks", Multirate Digital Signal Processing, Prentice-Hall, Inc. [online]. Retrieved from the Internet: <URL: peecee.dk/upload/download/411345>, (1983), 313-323.
El-Maleh, Khaled Helmi, "Classification-Based Techniques for Digital Coding of Speech-plus-Noise", Department of Electrical & Computer Engineering, McGill University, Montreal, Canada, A thesis submitted to McGill University in partial fulfillment of the requirements for the degree of Doctor of Philosophy., (Jan. 2004), 152 pgs.
Preves, David A., "Field Trial Evaluations of a Switched Directional/Omnidirectional In-the-Ear Hearing Instrument", Journal of the American Academy of Audiology, 10(5), (May 1999), 273-283.
"U.S. Appl. No. 13/189,990, Examiner Interview Summary mailed Sep. 18, 2013", 1 pgs.
"U.S. Appl. No. 13/948,011, Non Final Office Action mailed Sep. 18, 2014", 30 pgs.
"European Application U.S. Appl. No. 07250920.1, Response filed Aug. 12, 2014 to Office Action mailed Apr. 4, 2014", 13 pgs.
"Application U.S. Appl. No. 13/948,011, Preliminary Amendment filed Mar. 10, 2014", 6 pgs.
"European Application Serial No. 07250920.1, Office Action mailed Apr. 4, 2014", 6 pgs.
Haykin, Simon, "Chapter 7: Frequency-Domain and Subband Adaptive Filters", Adaptive Filter Theory, Fourth Edition, Prentice Hall, (2002), 344-384.
"U.S. Appl. No. 13/948,011, Advisory Action mailed Jun. 19, 2015", 4 pgs.
"U.S. Appl. No. 13/948,011, Final Office Action mailed Jan. 22, 2015", 32 pgs.
"U.S. Appl. No. 13/948,011, Response filed May 22, 2015 to Final Office Action mailed Jan. 22, 2015", 10 pgs.
"U.S. Appl. No. 13/948,011, Response filed Dec. 18, 2014 to Non Final Office Action mailed Sep. 18, 2014", 10 pgs.

SYSTEM FOR AUTOMATIC RECEPTION ENHANCEMENT OF HEARING ASSISTANCE DEVICES

RELATED APPLICATIONS

This patent application is a continuation of and claims the benefit of priority under 35 U.S.C. §120 to U.S. patent application Ser. No. 13/304,825, filed on Nov. 28, 2011, which application is a continuation of and claims the benefit of priority under 35 U.S.C. §120 to U.S. patent application Ser. No. 11/686,275, filed on Mar. 14, 2007, now issued as U.S. Pat. No. 8,068,627, which application claims the benefit of priority under 35 U.S.C. Section 119(e), to U.S. Provisional Application Ser. No. 60/743,481, filed on Mar. 14, 2006, each of which are incorporated by reference herein in its entirety.

TECHNICAL FIELD

This disclosure relates to hearing assistance devices, and in particular to method and apparatus for automatic reception enhancement of hearing assistance devices.

BACKGROUND

Patients who are hard of hearing have many options for hearing assistance devices. One such device is a hearing aid. Hearing aids may be worn on-the-ear, in-the-ear, and completely in-the-canal. Hearing aids can help restore hearing, but they can also amplify unwanted sound which is bothersome and sometimes ineffective for the wearer.

Many attempts have been made to provide different hearing modes for hearing assistance devices. For example, some devices can be switched between directional and omnidirectional receiving modes. A user is more likely to rely on directional reception when in a room full of sound sources. Directional reception assists the user in hearing an intended subject, instead of unwanted sounds from other sources.

However, even switched devices can leave a user without a reliable improvement of hearing. For example, conditions can change faster than a user can switch modes. Or conditions can change without the user considering a change of modes.

What is needed in the art is an improved system for changing modes of hearing assistance devices to improve the quality of sound and signal to noise ratio received by those devices. The system should be highly programmable to allow a user to have a device tailored to meet the user's needs and to accommodate the user's lifestyle. The system should provide intelligent and automatic switching based on programmed settings and should provide reliable performance for changing conditions.

SUMMARY

The above-mentioned problems and others not expressly discussed herein are addressed by the present subject matter and will be understood by reading and studying this specification.

The present subject matter provides systems, devices and methods for automatic reception enhancement of hearing assistance devices. Omnidirectional and directional microphone levels are compared, and are mixed based on their relative signal strength and the nature of the sound received.

Some examples are provided, such as an apparatus including: an omni input adapted to receive digital samples representative of signals received by an omnidirectional microphone having a first reception profile over a frequency range of interest; a directional input adapted to receive digital samples representative of signals received by a directional microphone having a second reception profile over the frequency range of interest; a mixing module connected to the omni input, the mixing module providing a mixing ratio for a block of digital samples, $\alpha(k)$; a compensation filter connected to the directional input and the mixing module, the compensation filter adapted to output a third reception profile which substantially matches the first reception profile; a first multiplier receiving the omni input and a value of $(1-\alpha(k))$ from the mixing module; a second multiplier receiving the directional input and a value of $\alpha(k)$ from the mixing module; and a summing stage adding outputs of the first multiplier and the second multiplier; wherein the output signal for sample n of block k, $s_c(n,k)$, is provided by: $s_c(n,k)=(1-\alpha(k))*s_O(n,k)+\alpha(k)\ s_D(n,k)$, where $s_O(n,k)$ is the output of the omni microphone for sample n of block k and $s_D(n,k)$ is the output of the compensation filter for sample n of block k, and $\alpha(k)=C*\alpha(k-1)+(1-C)*\beta(k)$, and where C is a constant between 0 and 1 and $\beta(k)$ is an output from the compensation filter for block k.

Some examples provide a power estimation scheme that is reliable against both steady and transient input. It provides examples of a target sound measurement (TSM) estimation scheme that is effective and efficient both in terms of storage size and computational efficiency. The examples employing a decision tree provide a weight factor between the omnidirectional and compensated directional signal. The resulting decision logic improves speech intelligibility when talking under noisy conditions. The decision logic also improves listening comfort when exposed to noise.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates to methods and apparatus for automatic reception enhancement in hearing assistance devices.

The method and apparatus set forth herein are demonstrative of the principles of the invention, and it is understood that other method and apparatus are possible using the principles described herein.

Figure 1:
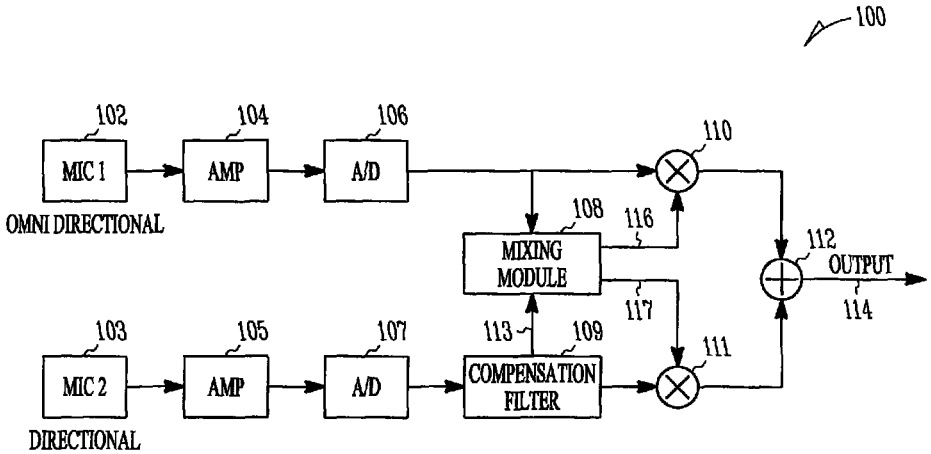
FIG. 1 shows a basic block diagram of the present system, according to one embodiment of the present subject matter.

FIG. 1 shows a basic block diagram of the present system 100, according to one embodiment of the present subject matter. Mic 1 102 is an omnidirectional microphone connected to amplifier 104 which provides signals to analog-to-digital converter 106. The sampled signals are sent to mixing module 108 and multiplier 110. Mic 1 103 is a directional microphone connected to amplifier 105 which provides signals to analog-to-digital converter 107. The sampled signals are sent to compensation filter 109 which processes the signal for multiplier 111. The mixing module generates mixing ratios and presents them on lines 116 and 117 to multipliers 110 and 111, respectively. The outputs of multipliers 110 and 111 are summed by summer 112 and output.

The compensation filter 109 is designed to substantially match the response profile of mic 2 to that of mic 1 on a KEMAR manikin when the sound is coming from zero degree azimuth and zero degree elevation. In so doing, this makes the signal 113 sent to mixing module 108 calibrated for response profile so that mixing module 108 can fairly mix the inputs from both the directional mic 103 and omnidirectional mic 102. More importantly, the mixing module can make decision based on the directional signal with a known frequency characteristics. The output of analog-to-digital convertor 106 is $s_O(n,k)$ and the output 116 from mixing module 108 is characterized as $(1-\alpha(k))$, where $\alpha(k)=C*\alpha(k-1)+(1-C)*\beta(k)$, and where C is a constant between 0 and 1 and $\beta(k)$ is an output from the instantaneous mode value for block k. When the device is in the omnidirectional mode, $\beta(k)$ has a value of 0. When the device is in the directional mode, $\beta(k)$ has a value of 1.

The output from compensation filter 109 is $s_D(n,k)$ and the output 117 of the mixing module 108 is $\alpha(k)$. Thus, the output signal 114 for sample n of block k, $s_c(n,k)$, is provided by:

$$s_c(n,k)=(1-\alpha(k))*s_O(n,k)+\alpha(k)s_D(n,k),$$

where $s_O(n,k)$ is the output of the omni microphone for sample n of block k and $s_O(n,k)$ is the output of the compensation filter 109 for sample n of block k, and $\alpha(k)=C*\alpha(k-1)+(1-C)*\beta(k)$, and where C is a constant between 0 and 1 $\beta(k)$ is an output from the instantaneous mode value for block k. When the device is in the omnidirectional mode, $\beta(k)$ has a value of 0. When the device is in the directional mode, $\beta(k)$ has a value of 1. The value of C is chosen to provide a seamless transition between omnidirectional and directional inputs. Common values of C include, but are not limited to a value corresponding to a time constant of three seconds.

Figure 2:
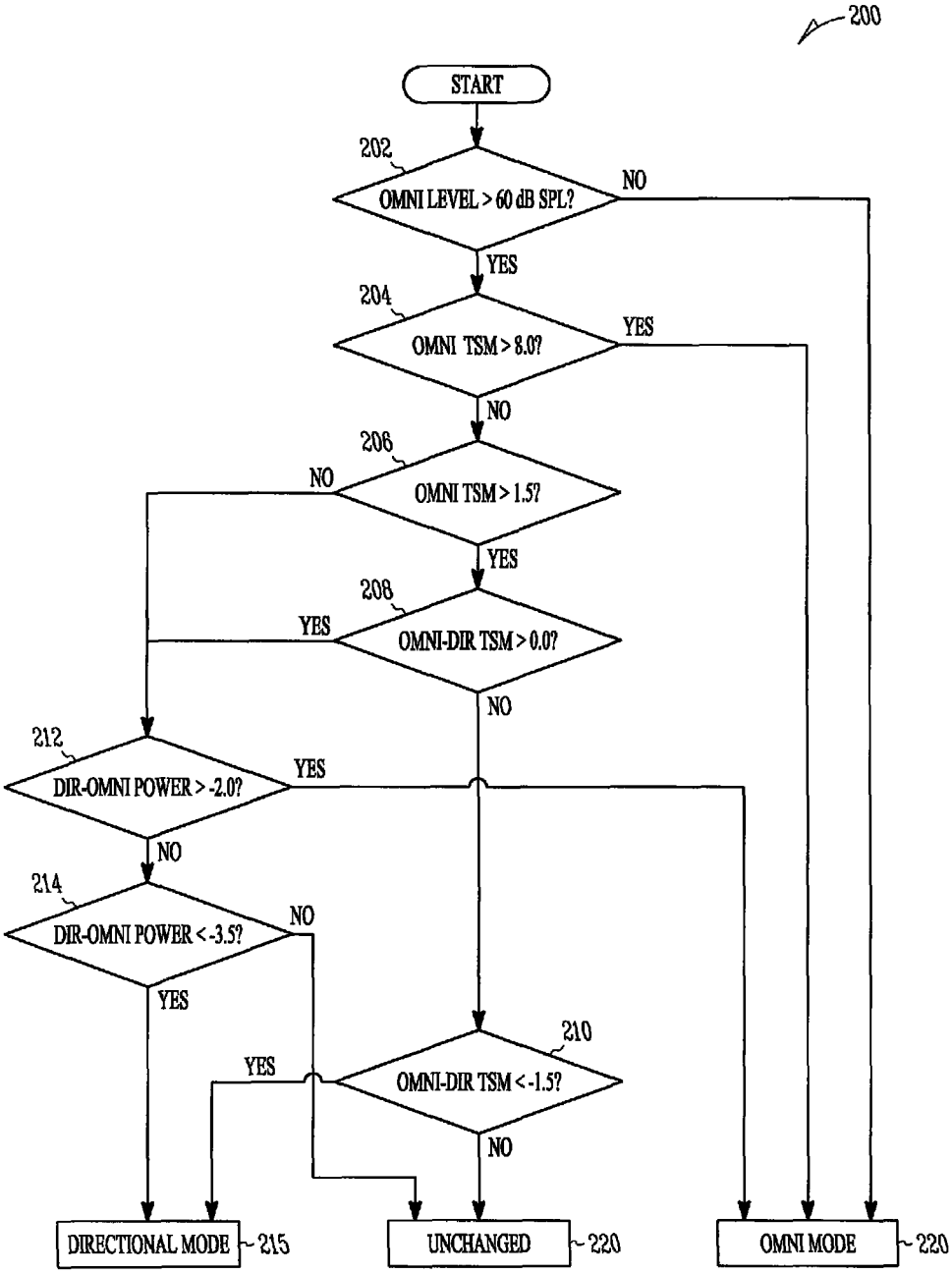
FIG. 2 is a decision tree showing mode selections based on conditions, according to various embodiments of the present subject matter.

FIG. 2 is a decision tree showing mode selections based on conditions, according to one embodiment of the present subject matter. The decision tree provides the $\beta(k)$ value based on the input signals for each block. The switching weight factor, $\alpha(k)$, is a smoothed version of $\beta(k)$ value.

Target sound measurements (TSMs) are used in the decision tree for deciding which mode to select. TSMs are generated from histogram data representing the number of samples in any given signal level. The average signal level $S_O$ is produced by a running average of the histogram data. A noise floor level is found at position $S_N$, of the histogram, which is the sound level associated with a the lowest peak in the histogram. Thus, the TSM is calculated as:

$$\text{TSM}=S_O-S_N.$$

Power measurements are provided by the equation:

$$P(n)=(1-\alpha)*P(n-1)+\alpha*E(n), \text{ if } E(n)<T \text{ or}$$

$$(1-\alpha)*P(n-1)+\alpha*T, \text{ if } E(n)>T \text{ and } E(n)>E(n-1),$$

Wherein T=a predetermined threshold. E(n) is the instantaneous power of the high-pass filtered input signal. The filter is designed to reduce the contribution of low frequency content to the power estimation.

This nonlinear equation for power provides a reliable estimate of the power for both steady and transient sounds. As a result, it helps improve the switching reliability and ensure that switching between modes does not overly fluctuate. Thus, T is set to reduce sudden changes in the power estimation.

FIG. 2 is intended to demonstrate the subject matter without being limiting or exclusive. The decision process according to such embodiments is as follows. The omni microphone input is tested to see if the current sound is relatively weak or strong 202. In one embodiment a sound level in excess of 60 dB SPL is characterized as strong and the flow proceeds to block 204. If the signal is weak, the device proceeds to block 216 to remain in omni mode.

At block 204, the current TSM of the omni microphone is tested to get a sense of whether the input sound is not random and not a simple sinusoid. If it is determined that the target signal is strong (e.g., speech), then the system deems the omni adequate to receive signals and flow goes to block 216. If the signal is not particularly strong, then the flow goes to block 206. In one embodiment, the omni TSM is tested to see if it exceeds 8.0.

At block 206, the system attempts to decide if the omni signal is close to that of the noise level. If the omni signal is stronger than the noise level, then flow proceeds to block 208. If not, then the flow proceeds to block 212. In one embodiment, the omni TSM is tested to see if it exceeds 1.5 before branching to block 208.

At block 208 the system detects whether the omni provides a better signal. If not the flow goes to block 210, where if it is determined that the directional is better source than the omni, the device enters a directional mode 215. If not, the device does not change modes 220. If the omni does provide a better signal at block 208, then the system attempts to determine whether the omni signal is quieter, and if so goes into omni mode 216. If not, the control goes to block 214. In one embodiment, the test at block 208 is whether the TSM of the difference between omni and directional signals is greater than 0.0. In one embodiment, the test at block 210 is whether that TSM difference is less than −1.5.

If the test of block 208 is positive, then the flow transfers to block 212, where it is determined if the power of the directional is greater than the power of the omni. If so, the device enters the omni mode 216, since it is a noisy environment and the system is selecting the quieter of the two. If not, control transfers to block 214. In one embodiment, the test at block 212 is whether the power of the directional signal exceeds that of the omni by more than −2.0.

At block 214, the system determines whether directional is quieter than the omni. If so, the system enters directional mode 215. If not, the system does not change modes 220. In one embodiment, the difference of the directional and omni powers is measured and if less than −3.5, then it branches to the directional mode 215.

It is understood that values and exact order of the forgoing acts can vary without departing from the scope of the present application and that the example set forth herein is intended to demonstrate the principles provided herein.

Figure 3:
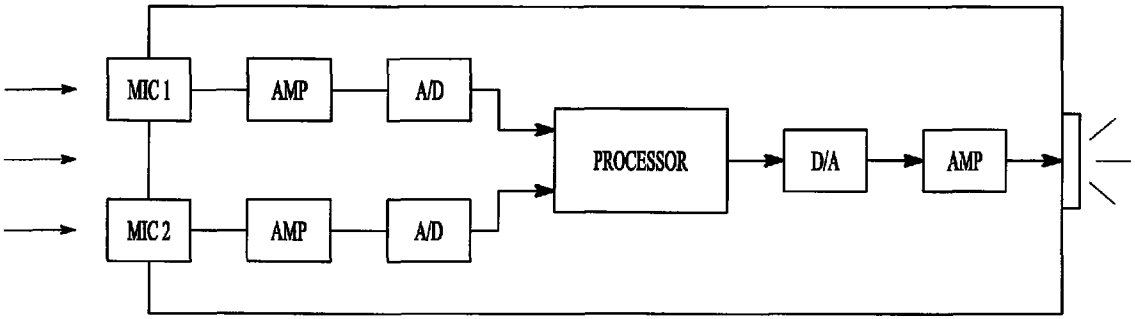
FIG. 3 is a block diagram of a hearing assistance device, incorporating the teachings of the present subject matter according to one embodiment of the present subject matter.

FIG. 3 is a block diagram of a hearing assistance device, incorporating the teachings of the present subject matter according to one embodiment of the present subject matter. In applications, such as hearing assistance devices, the processing can be done by a processor. In one embodiment, the processor is a digital signal processor. In one embodiment, the processor is a microprocessor. Other processors may be used and other component configurations may be realized without departing from the principles set forth herein. Furthermore, in various embodiments, the operations may be distributed in varying combinations of hardware, firmware, and software.

Figure 4:
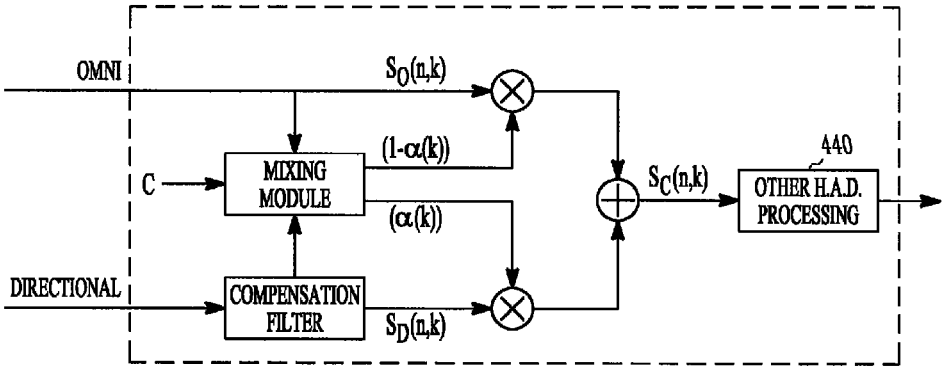
FIG. 4 is a block diagram of a signal process flow in the processor of FIG. 3. according to one embodiment of the present subject matter.

FIG. 4 is a block diagram of a signal process flow in the processor of FIG. 3. according to one embodiment of the present subject matter. As demonstrated by FIG. 4, the processor can perform additional process functions on the output. For example, in the case of a hearing aid, other hearing assistance device processing 440, includes hearing aid processes and can be done on the output signal. Such processing may be performed by the same processor as shown in FIG. 3 or by combinations of processors. Thus, the system is highly programmable and realizable in various hardware, software, and firmware realizations.

The present subject matter provides compensation for a directional signal to work with the given algorithms. It provides a power estimation scheme that is reliable against both steady and transient input. It provides a TSM estimation scheme that is effective and efficient both in terms of storage size and computational efficiency. The embodiments employing a decision tree provide a weight factor between the omnidirectional and compensated directional signal. The resulting decision logic improves speech intelligibility when talking under noisy conditions. The decision logic also improves listening comfort when exposed to noise.

It is further understood that the principles set forth herein can be applied to a variety of hearing assistance devices, including, but not limited to occluding and non-occluding applications. Some types of hearing assistance devices which may benefit from the principles set forth herein include, but are not limited to, behind-the-ear devices, on-the-ear devices, and in-the-ear devices, such as in-the-canal and/or completely-in-the-canal hearing assistance devices. Other applications beyond those listed herein are contemplated as well.

This application is intended to cover adaptations or variations of the present subject matter. It is to be understood that the above description is intended to be illustrative, and not restrictive. Thus, the scope of the present subject matter is determined by the appended claims and their legal equivalents.

What is claimed is:

1. An apparatus, comprising a hearing assistance device, the hearing assistance device including:

a first microphone input configured to receive a first microphone signal with a first reception profile over a frequency range;

a second microphone input configured to receive a second microphone signal with a second reception profile over the frequency range; and a digital signal processor configured to include:

a compensation filter connected to the second microphone input and configured to output the second microphone signal with a third reception profile which substantially matches the first reception profile;

a mixing module connected to the first microphone input to receive the first microphone signal with the first reception profile and connected to compensation filter to receive the second microphone signal with the third reception profile, the mixing module configured to provide a mixing ratio ($\alpha(k)$), for the first microphone signal with the first reception profile and the second microphone signal with the third reception profile based on relative signal strength and nature of the received signals;

a first multiplier configured to:

receive the first microphone signal with the first reception profile over the frequency range;

receive a first signal value of $(1-\alpha(k))$ from the mixing module; and provide a first multiplier output;

a second multiplier configured to:

receive the second microphone signal with the third reception profile over the frequency range;

receive a second signal value of $\alpha(k)$ from the mixing module; and provide a second multiplier output; and a summing stage connected to the first multiplier and the second multiplier, and configured to sum the first multiplier output and the second multiplier output.

2. The apparatus of claim 1, further comprising an omnidirectional microphone connected to the first microphone input.

3. The apparatus of claim 2, further comprising a directional microphone connected to the second microphone input.

4. The apparatus of claim 1, further comprising a directional microphone connected to the first microphone input.

5. The apparatus of claim 4, further comprising an omnidirectional microphone connected to the second microphone input.

6. The apparatus of claim 1, wherein the mixing module is configured to:

take target sound measurements (TSMs) of both the first microphone signal with the first reception profile and the second microphone signal with the third reception profile, take power measurements of both the first microphone signal with the first reception profile and the second microphone signal with the third reception profile, use the TSMs and the power measurements as inputs to determine whether to operate in a first microphone signal mode or in a second microphone signal mode, wherein the first microphone signal mode has a first value for a compensation filter output ($\beta(k)$) and the second microphone mode as a second value for a compensation filter output ($\beta(k)$); and derive a smoothed $\beta(k)$ value to provide a switching weight factor $\alpha(k)$.

7. The apparatus of claim 1, wherein the hearing assistance device further comprises hearing assistance device processing configured to receive and further process the sum of the first multiplier output and the second multiplier output for a user of the device.

8. The apparatus of claim 1, wherein the mixing module is configured to provide the mixing ratio ($\alpha(k)$) based on target sound measurements (TSMs) and power measurements of the first and second microphone signal.

9. The apparatus of claim 1, wherein the hearing assistance device is selected from a group of hearing assistance devices consisting of:

behind-the-ear hearing assistance device;

on-the-ear hearing assistance device;

in-the-ear hearing assistance device;

in-the-canal hearing assistance device; and completely-in-the-canal hearing assistance device.

10. A method implemented in a hearing assistance apparatus that includes a digital signal processor, comprising:

receiving a first microphone signal with a first reception profile over a frequency range;

receiving a second microphone signal with a second reception profile over the frequency range, and using the digital signal processor to:

convert the second microphone signal with the second reception profile into the second microphone signal with a third reception profile, the third reception profiles substantially matching the first reception profile;

determine a mixing ratio ($\alpha(k)$) for the first microphone signal with the first reception profile and the second microphone signal with the third reception profile based on the relative signal strength and nature of the first microphone signal with the first reception profile and the second microphone signal with the third reception profile;

multiply a first signal value ($1-\alpha(k)$) and the first microphone signal with the first reception profile to provide a first multiplier output signal;

multiply a second signal value $\alpha(k)$ and the second microphone signal with the third reception profile to provide a second multiplier output signal; and sum the first multiplier output signal and the second multiplier output signal.

11. The method of claim 10, wherein receiving the first microphone signal includes receiving an omnidirectional microphone signal.

12. The method of claim 11, wherein receiving the second microphone signal includes receiving a directional microphone signal.

13. The method of claim 10, wherein receiving the first microphone signal the first microphone signal includes receiving a directional microphone signal.

14. The method of claim 13, wherein receiving the second microphone signal includes receiving an omnidirectional microphone signal.

15. The method of claim 10, wherein determining the mixing ratio ($\alpha(k)$) includes:

taking target sound measurements (TSMs) of both the first microphone signal with the first reception profile and the second microphone signal with the third reception profile;

taking power measurements of both the first microphone signal with the first reception profile and the second microphone signal with the third reception profile;

using the TSMs and the power measurements as inputs to determine whether to operate in a first microphone signal mode or in a second microphone signal mode, wherein the first microphone signal mode has a first value for a compensation filter output ($\beta(k)$) and the second microphone mode as a second value for the compensation filter output ($\beta(k)$);

deriving a smoothed value for the compensation filter output ($\beta(k)$) to provide a switching weight factor $\alpha(k)$;

multiplying a first signal value ($1-\alpha(k)$) and the first microphone signal with the first reception profile to provide a first multiplier output signal;

multiplying a second signal value $\alpha(k)$ and the second microphone signal with the third reception profile to provide a second multiplier output signal; and summing the first multiplier output signal and the second multiplier output signal.

16. A method implemented in a hearing assistance apparatus that includes a digital signal processor, comprising:

receiving a first microphone signal with a first reception profile over a frequency range and a second microphone signal with a second reception profile over the frequency range;

using the digital signal processor to:

convert the second microphone signal with the second reception profile over the frequency range to the second microphone signal with a third reception profile over the frequency range, the third reception profile substantially matching the first reception profile;

take target sound measurements (TSMs) of both the first microphone signal with the first reception profile and the second microphone signal with the third reception profile;

take power measurements of both the first microphone signal with the first reception profile and the second microphone signal with the third reception profile;

use the TSMs and the power measurements as inputs to determine whether to operate in a first microphone signal mode or in a second microphone signal mode, wherein the first microphone signal mode has a first value for a compensation filter output ($\beta(k)$) and the second microphone mode as a second value for a compensation filter output ($\beta(k)$);

derive a smoothed value for the compensation filter output ($\beta(k)$) to provide a switching weight factor $\alpha(k)$;

multiply a first signal value ($1-\alpha(k)$) and the first microphone signal with the first reception profile to provide a first multiplier output signal;

multiply a second signal value $\alpha(k)$ and the second microphone signal with the third reception profile to provide a second multiplier output signal; and sum the first multiplier output signal and the second multiplier output signal.

17. The method of claim 16, wherein receiving the first microphone signal includes receiving an omnidirectional microphone signal.

18. The method of claim 17, wherein receiving the second microphone signal includes receiving a directional microphone signal.

19. The method of claim 16, wherein receiving the first microphone signal includes receiving a directional microphone signal.

20. The method of claim 19, wherein receiving the second microphone signal includes receiving an omnidirectional microphone signal.

* * * * *